US005171081A

United States Patent [19]

Pita et al.

[11] Patent Number: 5,171,081

[45] Date of Patent: Dec. 15, 1992

[54] CHEMILUMINESCENT REACTIVE VESSEL

[76] Inventors: Joe W. Pita, 880 NE. 75th St., Miami, Fla. 33138; Scott Mershon, 1009 Meridian Ave., #16, Miami Beach, Fla. 33139; Michael A. Muskat, 1230 95th St., Bay Harbor, Fla. 33154

[21] Appl. No.: 889,981

[22] Filed: May 29, 1992

[51] Int. Cl.[5] ..... F21V 8/00; F21V 33/00

[52] U.S. Cl. ..... 362/34; 362/101

[58] Field of Search ..... 362/34, 56, 101

[56] References Cited

U.S. PATENT DOCUMENTS

| | | | |
|---|---|---|---|
| 3,354,828 | 11/1967 | Shefler et al. | 362/34 |
| 3,735,113 | 5/1973 | Stott | 362/101 |
| 4,064,428 | 12/1977 | Van Zandt | 362/34 |
| 4,379,320 | 4/1983 | Mohan et al. | 362/34 |
| 4,563,726 | 1/1986 | Newcomb et al. | 362/34 |
| 4,814,949 | 3/1989 | Elliott | 362/34 |
| 5,018,450 | 5/1991 | Smith | 362/34 |
| 5,044,509 | 9/1991 | Petrosky et al. | 215/366 |
| 5,067,051 | 11/1991 | Ladyjensky | 362/34 |

*Primary Examiner*—Richard R. Cole
*Attorney, Agent, or Firm*—Richard C. Litman

[57] ABSTRACT

A vessel for the containment of food or drink produces a chemiluminescent reaction when activated to provide an enjoyable effect for the user of the vessel. The vessel has inner and outer walls and floors with a space therebetween, and includes a chemiluminescent fluid within at least the floor space. Another chemiluminescent fluid is contained separately within a toroidal tube in the upper or lower rim of the vessel. The vessel and tube are preferably formed of a flexible and translucent plastic. Thus, when the rim is flexed the toroidal tube is compressed, causing the fluid contained therein to rupture a thin membrane separating the volumes of the tube and wall or floor space and allowing the fluid contained within the tube to flow into the space between the two walls and floors to mix with the other chemiluminescent fluid and thereby produce an interesting and pleasing glow from the vessel. A further variation on the above invention provides for containment of one of the fluids in a capsule in the base of the container. While a specific combination of chemicals known in the art is disclosed, a variety of chemiluminescent compounds may be used to provide different colors, brightnesses, reaction times, etc. The vessel may also be provided in a multitude of different shapes, so long as they are topologically related.

20 Claims, 3 Drawing Sheets

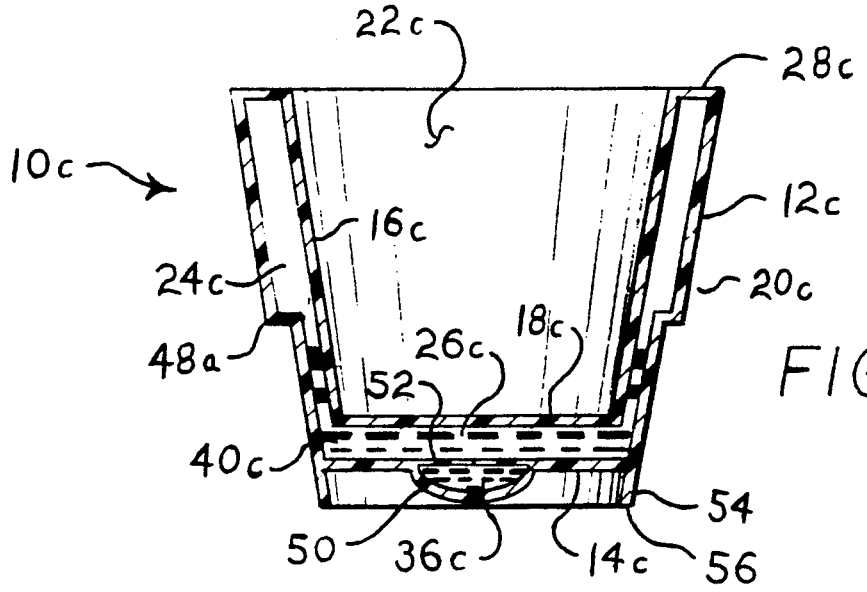
FIG. 5
FIG. 6
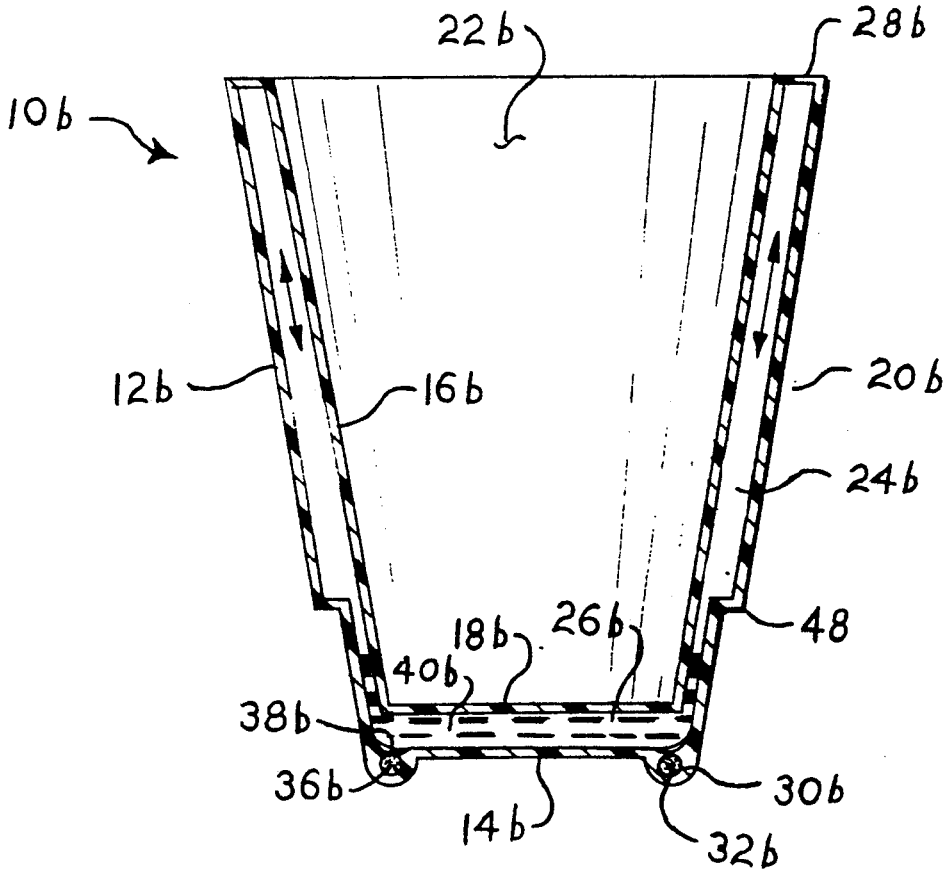

CHEMILUMINESCENT REACTIVE VESSEL

FIELD OF THE INVENTION

This invention relates generally to vessels and containers used in the consumption of food and/or beverages, and more specifically to such vessels providing for chemiluminescence by means of inner and outer walls and at least two compartments therein for the containment of chemiluminescent reactive substances.

BACKGROUND OF THE INVENTION

It has long been recognized that many persons find food or drink more attractive, and the activity involved in consuming such food or drink more enjoyable, if the utensils associated with such consumption are provided with a novel appearance. This is particularly true in social environments, such as at parties and drinking establishments.

It is further well known that such places which allow social drinking or related activities, generally provide relatively subdued lighting. This is done for several reasons, e.g. to provide a more romantic atmosphere for patrons, etc. While supplemental lighting is also usually provided in the way of candles or other decorative as well as functional lighting, little has been done in the way of phosphorescence in such environments. While elements or chemicals providing such phosphorescence are well known, many (e.g., radium) are now recognized to be extremely hazardous and are no longer used for such purposes.

Nevertheless, some form of luminescence for articles in such an environment would be well appreciated, particularly if such luminescence could be applied to any food and/or drink containers used in such a location of subdued lighting. The need arises for vessels or containers for food or drink, which vessels or containers provide means for safe luminescence. The vessels must provide total containment of any chemicals contained therein for any chemiluminescent reaction, and must not release any dangerous chemicals, radiation or other hazards. Finally, as such chemiluminescent reactions as are adapted to the present invention are recognized to be of relatively short duration, any chemicals providing such chemiluminescence must be prevented from reacting until such time as the chemiluminescent reaction is desired.

DESCRIPTION OF THE RELATED ART

U.S. Pat. No. 4,064,428 issued to R. T. Van Zandt on Dec. 20, 1977 discloses a Chemical Light Device. The device comprises an outer tube containing two smaller internal tubes, the smaller internal tubes containing oxalate and activator compounds. A weight within the larger tube may be accelerated toward the smaller tubes, causing them to break and release the chemicals to mix together. The purpose and function of the device are unlike those of the present invention.

U.S. Pat. No. 4,379,320 issued to A. G. Mohan et al. on Apr. 5, 1983 discloses a Chemical Lighting Device which uses a third compound in the form of a sheet polymer within the walls of the container in order to provide a color shift for the fluorescent reaction. The mechanical means disclosed for the mixing of the chemicals is unlike that of the present invention.

U.S. Pat. No. 4,814,949 issued to L. Elliott on Mar. 21, 1989 discloses a Chemiluminescent Device including an absorbent material saturated with a first chemical, and a second chemical contained within a glass ampule. The second chemical is absorbed into the absorbent material and mixes with the first chemical to provide a chemiluminescent reaction, when the ampule is broken. The outer container and absorbent material may be formed in a variety of shapes, but do not anticipate the present invention.

U.S. Pat. No. 5,044,509 issued to T. Petrosky et al. on Sep. 3, 1991 discloses an Infant Nursing Bottle And Luminescent Indicator. The luminescent fluid is displaced by the weight of a baby bottle within the apparatus, to displace the fluid upward in tubular indicators depending upon the weight and therefore the volume of fluid within the baby bottle. The device fails to disclose the specific luminescent fluid used and provides for only a single fluid, thereby precluding any chemical reaction to produce the luminescence. Such a chemical would require an external energy source (e.g., light) to excite the luminescent fluid. As the environment of the present invention would likely provide little ambient light, the Petrosky device would be unsuitable unless a separate light source were provided.

Finally, U.S. Pat. No. 5,067,051 issued to J. Ladyjensky on Nov. 19, 1991 discloses a Chemiluminescent Lighting Element comprising a tubular member with a central disk dividing the interior volume of the tube into two compartments. Each compartment contains one of the chemiluminescent fluids, and when the disk is displaced the two chemicals mix together to produce the chemiluminescent reaction. The physical structure of the device is unsuitable for adaptation to the present invention.

None of the above noted patents, either singly or in combination, are seen to disclose the specific arrangement of concepts disclosed by the present invention.

SUMMARY OF THE INVENTION

By the present invention, an improved vessel incorporating luminescent means is disclosed.

Accordingly, one of the objects of the present invention is to provide an improved vessel adapted for use as a food or beverage container.

Another of the objects of the present invention is to provide an improved vessel providing containment of chemiluminescent fluids within inner and outer walls of the vessel.

Yet another of the objects of the present invention is to provide an improved vessel including means for separation of the chemiluminescent fluids contained therein.

Still another of the objects of the present invention is to provide an improved vessel including means for the destruction of the separation means between the chemiluminescent fluids.

A further object of the present invention is to provide an improved vessel which includes translucent or transparent walls in order that any chemiluminescent reaction therein may be observed.

An additional object of the present invention is to provide an improved vessel in a variety of shapes for use in the partaking of foods and/or beverages.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 5 is an elevational view in section of a further alternate embodiment.

FIG. 6 is an elevational view in section of another alternative embodiment.

Similar reference characters designate corresponding parts throughout the several figures of the drawings.

DESCRIPTION OF THE PREFERRED EMBODIMENTS

Figure 1:
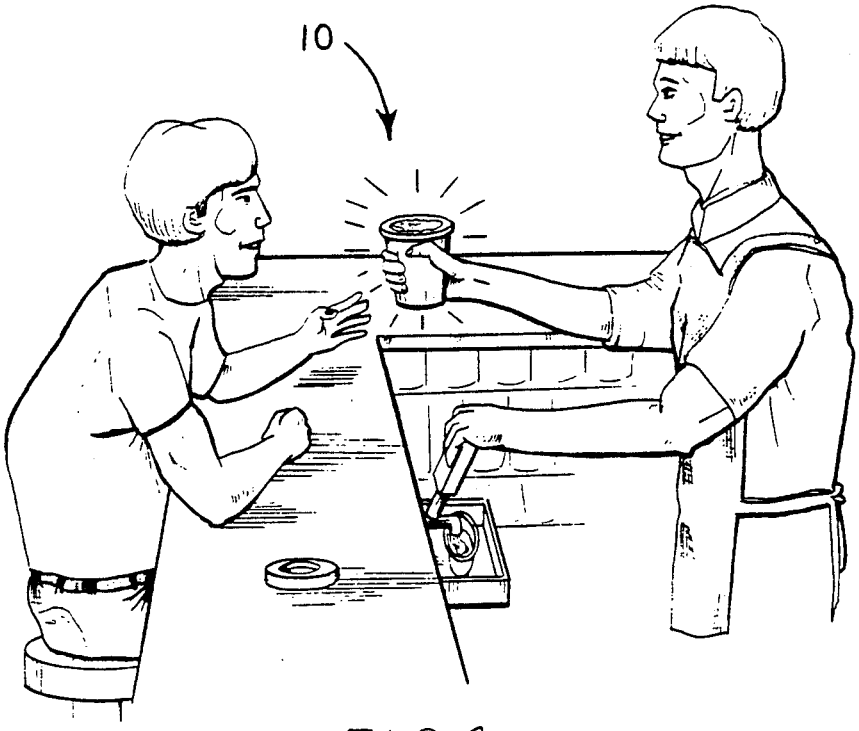
FIG. 1 is an environmental view showing the use of one embodiment of the vessel of the present invention.
Figure 2:
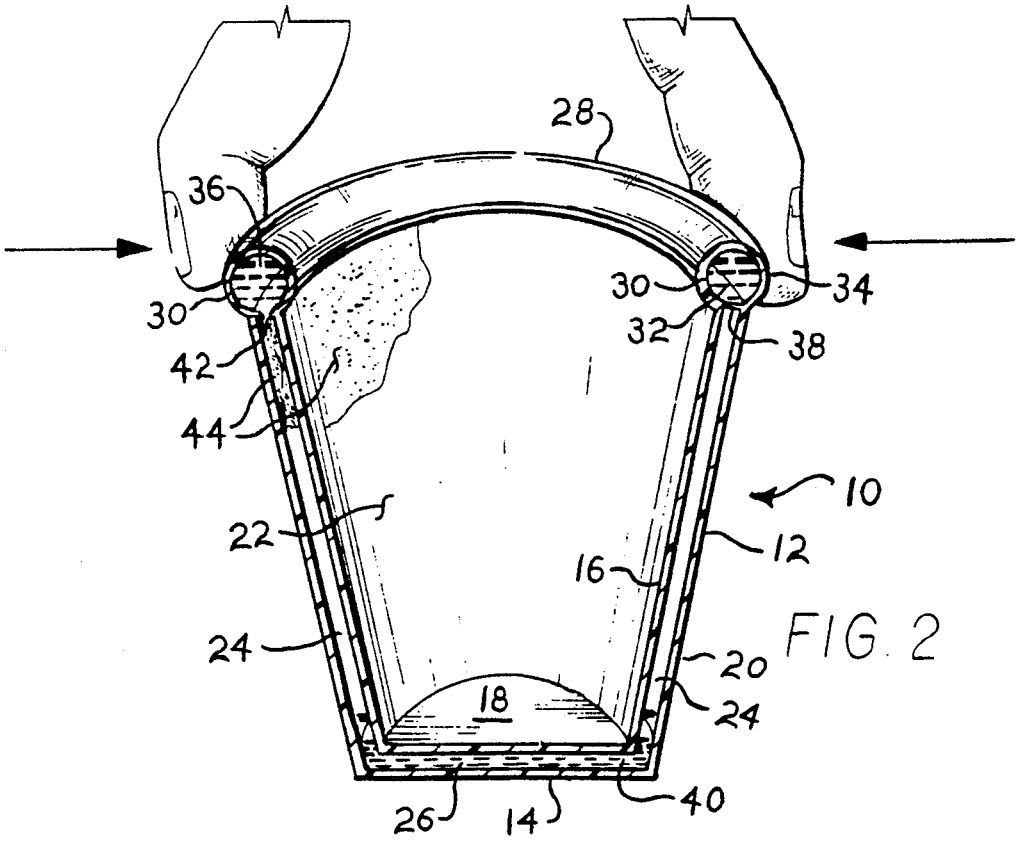
FIG. 2 is a perspective view in section of a vessel of the present invention, showing the interior construction thereof and the means providing for the mixing of the chemiluminescent fluids contained therein.
Figure 3:
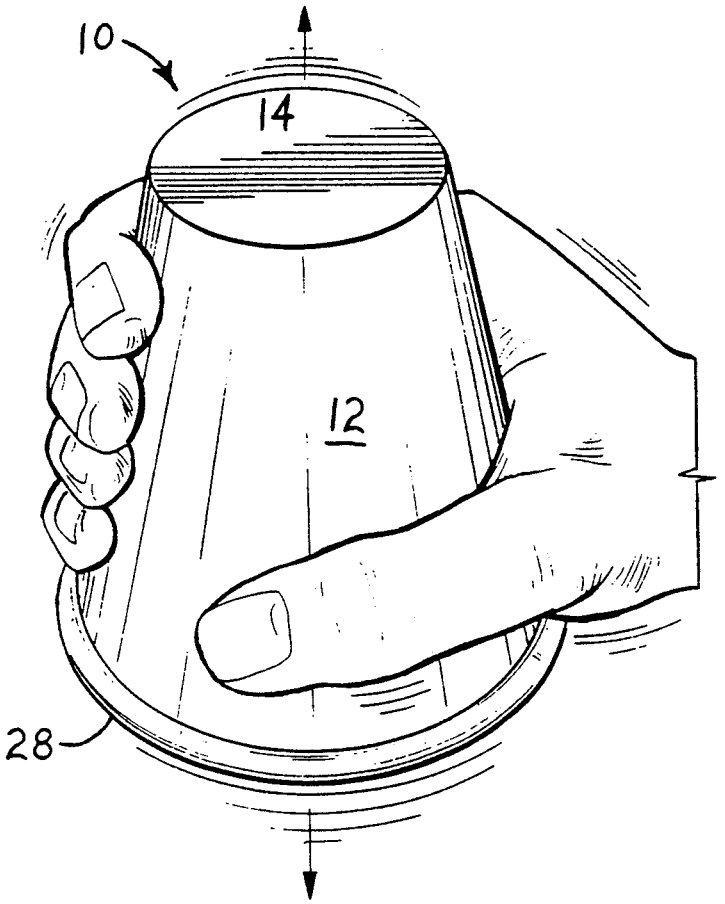
FIG. 3 is a perspective view showing a means of mixing or activating the chemicals contained therein to produce the desired luminescence.
Figure 4:
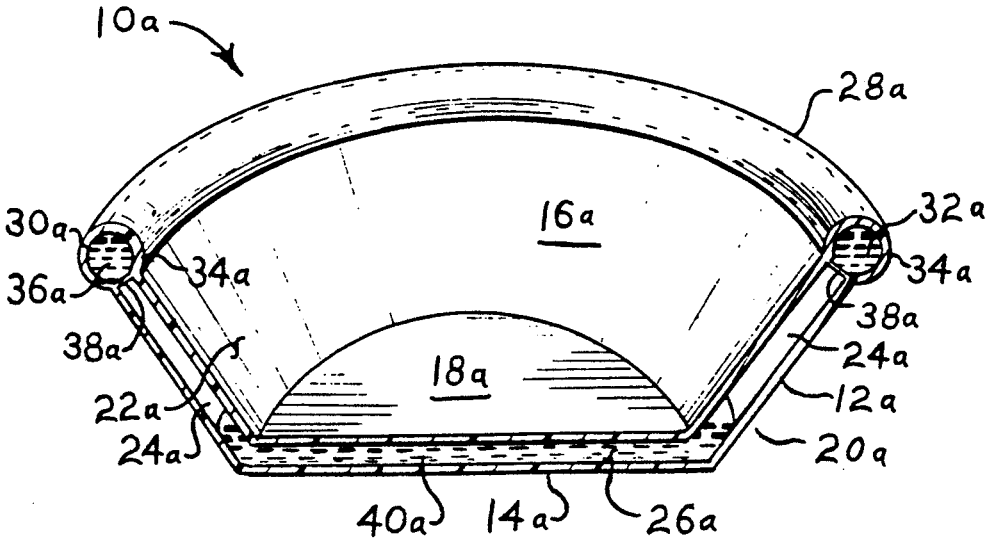
FIG. 4 is a perspective view in section of an alternate embodiment of the present invention.

Referring now to the drawings, particularly FIGS. 1 through 3 of the drawings, the present invention will be seen to relate to a vessel 10 providing a chemiluminescent reaction. Vessel 10 of FIGS. 1 through 3 will be seen to be in the general form of a beverage cup or container, but topologically is related to a concave disc shape in the manner of a plate, dish or bowl. Thus, the vessel 10*a* of FIG. 4 is an alternate embodiment of the vessel 10 of FIGS. 1 through 3, employing the same structure and topological features. Vessels 10 and 10*a* are preferably formed of a flexible, transparent or at least translucent material, such a polyethylene plastic, for reasons which will be apparent as the invention is further described.

The details of the construction of vessel 10 are most clearly shown in FIG. 2 of the drawings. Vessel 10 provides a first wall 12 and first floor 14, and second wall 16 and second floor 18. First wall and floor 12 and 14 serve to form a convex outer container 20 for vessel 10, while second wall and floor 16 and 18 form a concave inner container 22 for vessel 10. Outer and inner containers 20 and 22 are spaced apart in order to provide a wall space 24 and floor space 26 between outer and inner containers 20 and 22. Wall space 24 and floor space 26 provide a volume for the mixing and reaction of any chemiluminescent fluids which are contained therein, as will be described below.

First wall 12 and second wall 16 are joined and sealed together at the upper rim 28 of vessel 10, thus providing a completely enclosed and sealed wall space 24 and floor space 26. Upper rim 28 further provides a toroidal tube 30 completely enclosed within upper rim 28. Tube 30 includes an inner volume 32 which in turn is completely sealed and enclosed by the side wall 34 of tube 30, and provides for the containment of a first chemiluminescent fluid 36. However, the lower side of tube 30 is sealed by a thin membrane 38 which communicates directly with wall space 24 contained between outer wall 12 and inner wall 16. The inner volume 32, and any first chemiluminescent fluid 36 contained therein, of toroidal tube 30 is therefore separated from the wall space 24 and floor space 26 of vessel 10 by membrane 38.

As noted above, wall space 24 and floor space 26 provide a volume for the mixing of any chemiluminescent fluids contained therein. Floor space 24 also preferably provides sufficient volume for the containment of a second chemiluminescent fluid 40, although the volume provided within wall space 24 may also be used for such containment if desired.

Chemicals capable of providing the desired chemiluminescence for the present invention are of course well known, and the present invention makes no claim to the invention of the chemicals themselves, but rather their use in combination with a novel vessel formed to take advantage of the characteristics of such chemiluminescent materials. An abundance of such chemical compounds are known, capable of producing a variety of colors under varying conditions. An example of such chemicals which may be used in combination with the present invention are as follows:

| ACTIVATOR | AMOUNT |
|---|---|
| dimethyl phthalate | 81.40% |
| tert-butyl alcohol | 13.30% |
| 90% hydrogen peroxide | 5.29% |
| sodium salicylate | 0.01% |

The combination of the above chemicals forming the chemiluminescent activator are described as first chemiluminescent fluid 36 for the purposes of the present invention, and are preferably contained within toroidal tube 30 as described above.

| OXALATE | AMOUNT |
|---|---|
| dibutyl phthalate | 88.6% |
| bis(2,4,5-trichloro-6-carbopentoxyphenyl)oxalate | 11.1% |
| 1-chloro-9,10-bis(phenyl-ethynyl)anthracene | 0.3% |

The above chemicals comprising the oxalate for the present invention are described as second chemiluminescent fluid 40, which is preferably contained within floor space 26 but is also free to flow throughout wall space 24 up to the lower side 38 of tube 30. The above activator or first chemiluminescent fluid 36, and oxalate or second chemiluminescent fluid 40, will produce a light in the yellow range of the visible spectrum when combined in approximately a three (oxalate or second fluid 40) to one (activator or first fluid 36) ratio.

Preferably, the volumes for the containment of fluids 36 and 40 are optimized in vessel 10 for maximum efficiency. While it is understood that an excessive amount of either activator fluid 36 or oxalate fluid 40 is harmless and the chemiluminescent reaction will still occur to the limits of the undersupplied fluid, an excessive amount of either fluid is obviously wasteful, particularly in the specifically formed volumes provided by the present invention. Accordingly, the following example is provided for a typically sized vessel 10 in order to demonstrate typical dimensions between outer floor 14 and inner floor 18, as well as a typical internal diameter for toroidal tube 30.

A container in the general shape of a drinking cup, such as vessel 10 of FIGS. 1 through 3, will typically have a bottom surface on the order of two inches in diameter and an upper rim some three inches in diameter. If one assumes the above dimensions and provides an inner diameter for toroidal tube 30 of 0.125 inch, the resultant volume for tube 30, and therefore the volume of activator or first fluid 36 contained therein, will be seen to be approximately 0.462 cubic inches.

As noted above, approximately three times the amount of oxalate or second fluid 40 must be provided within wall space 24 and floor space 26. Preferably, the total required volume is provided within floor space 26, as when first fluid 36 is released from toroidal tube 30 some wall volume for first fluid 36 must be provided. Thus, in order to provide sufficient volume within floor space 26 for the containment of the optimal volume of second fluid 40 (a total of 3 times 0.462 cubic inches, or 1.386), an internal distance of approximately 0.44 inch must be provided between outer floor 14 and inner floor 18 assuming a floor diameter of two inches as noted above.

Preferably, when first fluid 36 is allowed to flow from toroidal tube 30 and mix with second fluid 40, the resultant volume of the two fluids 36 and 40 will be sufficient to completely fill the wall space 24 and the floor space 26 of vessel 10. Calculation will show that the desired internal distance between outer wall 14 and inner wall 16, in order to be completely filled by a first fluid 36 volume of 0.462 cubic inches, is approximately 0.02 inch. Thus, a vessel 10 so dimensioned will provide a pleasant translucent yet luminous effect as first and second fluids 36 and 40 are mixed within wall space 24. The relatively narrow space provided by the above example will also be seen to result in relatively slow mixing of the two fluids 36 and 40, thereby resulting in a more interesting non uniform luminescent pattern which will also require more time to completely react, thus prolonging the enjoyment of the effect.

The foregoing is merely an example of the dimensions which may be calculated for a given vessel 10 for the specific activator fluid 36 and oxalate fluid 40 provided as examples above. Obviously, different fluids, as well as differently sized and shaped vessels, will result in different optimum dimensions for the interior diameter of toroidal tube 30 and floor space 26. For example, if a brighter and more rapid reaction is desired, the toroidal tube 30 and floor space 26 volumes may be enlarged accordingly. Alternatively, such a vessel 10 may be made narrower and/or shorter to reduce the amount of surface area containing wall space 24, thereby allowing the thickness between outer and inner walls 14 and 16 to be increased to achieve the same volume. Yet another alternative would be to provide a larger internal diameter for tube 30, and thus more volume for first or activator fluid 36, and allow second fluid 40 to at least partially fill wall space 24 as well as floor space 26 of vessel 10. Alternatively, the floor could be made solid with second fluid 40 contained entirely within wall space 24 of vessel 10. As can be seen, an abundance of variations on the basic principle are possible, two additional variations of which will be discussed in detail further below.

As noted above, FIG. 4 provides a further embodiment of the present invention. The basic concept remains the same between the two embodiments, but the specific shapes of the various components are revised. Accordingly, the components 12 through 40 described for vessel 10 are respectively numbered as **12*a* through 40*a* for vessel 10*a*. Vessel 10*a*** will be seen to provide a container in the general form of a serving dish.

Vessel 10 (or **10*a*) is initially provided with the toroidal tube 30 intact and with first and second chemiluminescent fluids 36 and 40 sealed therein. The integrity of tube 30, and membrane 38, serves to prevent any mixing of the two fluids 36 and 40. When vessel 10 is to be used, the server may grip the upper rim 28 of vessel 10 and squeeze the opposing sides together as shown in FIG. 2. While the flexible nature of the preferred material comprising the balance of vessel 10 will allow upper rim 30 to be distorted with no permanent effects, the resulting compression of the inner volume 32 of toroidal tube 30, and the inherent lack of compressibility of first chemiluminescent fluid 36, will result in the rupture 42 of thin membrane 38 between first fluid 36 and the space 24 and 26 containing second fluid 40. The resulting rupture 42 of membrane 38 in the floor of tube 30 will allow the first chemiluminescent fluid 36 to flow outward therefrom by means of the only path possible, through the rupture 42 of membrane 38 of tube 30 and into the wall space 24 of vessel 10. First fluid 36 will continue to flow downward as shown at 44 until contacting and mixing with second chemiluminescent fluid 40 in the floor space 26 of vessel 10. If it is desired to accelerate the mixing and reaction of the two fluids 36 and 40, vessel 10 may be inverted and/or shaken as desired as shown in FIG. 3**.

At this point, vessel 10 may be used as any other similarly shaped utensil, by filling it with the beverage or other substance desired and mixing as required. Generally, the step of preparing the beverage or other substance will require a minute or two, allowing further time for the chemiluminescent reaction to develop. When the beverage or other substance contained within vessel 10 is served, the chemiluminescent reaction will generally have developed to produce a pleasant and interesting luminous glow from vessel 10. The light produced by the reaction of first and second fluids 36 and 40 may last from several minutes to over an hour, depending upon the specific chemicals used and also their temperature. As most chemical reactions are accelerated with heat, the chemiluminescent glow provided by vessel 10 may be somewhat brighter but shorter in duration if a hot beverage or substance is served within vessel 10.

As noted above, many variations are conceivable on the above invention, such as different chemicals to produce variations in color, brightness and duration of the reaction. The floor, wall space and volume of the toroidal tube within the rim of vessel 10 may be varied in order to provide room for greater or lesser quantities of chemiluminescent fluids. Also, the preferably translucent material used for the manufacture of vessel 10 may be colored or shaded to produce further color effects in combination with the chemicals contained within the walls and rim of vessel 10.

Further examples of variations on the present invention are shown in FIGS. 5 and 6. The vessel **10*b* of FIG. 6 will be seen to be of a similar configuration to the vessel 10 of FIGS. 1 and 2, the basic difference being the location of toroidal tube 30*b* at the rim 46 of outer floor 14*b*. The remaining components 12*b* through 40*b* of container 10*b* will be seen to be equivalent to those components 12 through 40 of container or vessel 10, or components 12*a* through 40*a* of container or vessel 10*a*, with the exception of the location of toroidal tube 30*b* as discussed above. However, thin membrane 38*b* still serves to separate the interior volume 24*b* and 26*b* from the interior volume 32*b* of container 10*b*, just as those respective components are separated in containers 10 and 10*a*. First and second fluids 36*b* and 40*b* are respectively contained within toroidal tube 30*b* and floor and wall space 24*b* and 26*b* of container 10*b*, in a manner similar to the arrangement of vessels or containers 10 and 10*a*. Such containers may be further provided with a medial circumferential ridge 48** to aid in the stacking of the containers, if desired.

The fluids 36b and 40b of vessel 10b may be activated by rupturing the thin membrane 38b between toroidal tube 30b and wall and floor space 24b and 26b, similar to the means used to provide for the mixing of the two fluids in the other containers 10 and 10a of the present invention. However, as the bottom of container 10b is formed of two floors 14b and 18b which serve to stiffen the base of container 10b, it may be preferable to firmly strike the lower rim 46 of container 10b on a relatively hard surface to compress toroidal tube 30b and cause membrane 38b to rupture due to the pressure of first chemiluminescent fluid 36b. Container 10b may then be inverted and/or shaken to cause a mixing of the two fluids 36b and 40b, in a manner similar to that used for the mixing of fluids 36 and 40 with container 10. The resulting effect is essentially identical for any of the containers 10, 10a, or 10b of the present invention.

In some cases, there may be some risk of an upper toroidal rim 30 or 30a or lower toroidal rim 30b being compressed during shipment of containers 10, 10a or 10b, thereby causing the inadvertent rupture of their respective membranes 38 through 38b and the early activation of their respective chemiluminescent fluids. In order to preclude such a possibility, container 10c of FIG. 5 is provided. Container 10c will be seen to include all of the respective features and components 12c through 28c corresponding to components 12 through 28 of container 10, and further includes first and second chemiluminescent fluids 36c and 40c equivalent to fluids 36 and 40 of vessel 10. Medial circumferential stacking ridges 48a may be included if desired, as in the case of container 10b of FIG. 6. However, outer floor 14c of container 10c includes a separate capsule 50 which is separated from the volume of floor space 26c by a thin membrane 52, similar to the membranes 38 through 38b of vessels 10 through 10b. Capsule 50 contains a first chemiluminescent fluid 36c, while floor space 26c and/or wall space 24c provide a volume for second chemiluminescent fluid 40c. In order to guard and protect capsule 50 from inadvertent compression and the resulting rupture of thin membrane 52, a depending circumferential rim 54 is provided with a lower edge 56 which extends downward at least slightly below capsule 50.

Activation of chemiluminescent fluids 36c and 40c of vessel 10c is accomplished by essentially the same means as that used in vessels or containers 10 through 10b, by rupturing the thin membrane (in the case of vessel 10c, membrane 52) between the chemiluminescent fluids. This may be accomplished in the case of container 10c by using thumb or other pressure upon capsule 50, thereby compressing the fluid 36c within and causing membrane 52 to rupture. Mixing is accomplished in the same way as for containers 10 through 10b.

It is to be understood that the present invention is not limited to the sole embodiments described above, but encompasses any and all embodiments within the scope of the following claims.

I claim:

1. A vessel having an outer convex wall communicating with an outer floor and an inner concave wall communicating with an inner floor and thereby defining a continuous wall space and floor space therebetween, said outer wall and said inner wall sealed together at a common upper rim, said upper rim including a toroidal tube monolithically formed therewith, said toroidal tube having a lower side including a relatively thin membrane communicating with said wall space, said toroidal tube containing a first chemiluminescent fluid, at least said floor space containing a second chemiluminescent fluid, whereby said toroidal tube is compressed causing said relatively thin membrane to rupture and said first chemiluminescent fluid flows from said toroidal tube through said wall space to mix with said second chemiluminescent fluid within said floor space and said wall space to produce a chemiluminescent reaction when said upper rim of said vessel is distorted.

2. The vessel of claim 1 wherein;

said vessel is in the form of a beverage container.

3. The vessel of claim 1 wherein;

said vessel is in the form of a serving dish.

4. The vessel of claim 1 wherein;

said outer convex wall, said outer floor, said inner concave wall, said inner floor, and said upper rim are formed of a flexible and translucent material.

5. The vessel of claim 1 wherein;

said first chemiluminescent fluid is an activator for said chemiluminescent reaction.

6. The vessel of claim 1 wherein;

said second chemiluminescent fluid is an oxalate for said chemiluminescent reaction.

7. A vessel having an outer convex wall communicating with an outer floor and an inner concave wall communicating with an inner floor and thereby defining a continuous wall space and floor space therebetween, said outer wall and said inner wall sealed together at a common upper rim, said lower floor defined by a lower rim, said lower rim including a toroidal tube monolithically formed therewith, said toroidal tube having an upper side including a relatively thin membrane communicating with said floor space, said toroidal tube containing a first chemiluminescent fluid, at least said floor space containing a second chemiluminescent fluid, whereby said toroidal tube is compressed causing said relatively thin membrane to rupture and said first chemiluminescent fluid flows from said toroidal tube through said floor space to mix with said second chemiluminescent fluid within said floor space and said wall space to produce a chemiluminescent reaction when said lower rim of said vessel is distorted.

8. The vessel of claim 7 wherein;

said vessel is in the form of a beverage container.

9. The vessel of claim 7 wherein;

said vessel is in the form of a serving dish.

10. The vessel of claim 7 wherein;

said outer convex wall, said outer floor, said inner concave wall, said inner floor, said upper rim and said lower rim are formed of a flexible and translucent material.

11. The vessel of claim 7 wherein;

said first chemiluminescent fluid is an activator for said chemiluminescent reaction.

12. The vessel of claim 7 wherein;

said second chemiluminescent fluid is an oxalate for said chemiluminescent reaction.

13. A vessel having an outer convex wall communicating with an outer floor and an inner concave wall communicating with an inner floor and thereby defining a continuous wall space and floor space therebetween, said outer wall and said inner wall sealed together at a common upper rim, said outer floor including a capsule formed thereupon, said capsule including a first chemiluminescent fluid and having a relatively thin membrane communicating with said floor space, at least said floor space containing a second chemiluminescent fluid, whereby said capsule is compressed causing said relatively thin membrane to rupture and said first chemiluminescent fluid flows from said capsule into said floor space to mix with said second chemiluminescent fluid within said floor space to produce a chemiluminescent reaction when said capsule of said vessel is distorted.

14. The vessel of claim 13 wherein;

said vessel is in the form of a beverage container.

15. The vessel of claim 13 wherein;

said vessel is in the form of a serving dish.

16. The vessel of claim 13 wherein;

said outer convex wall, said outer floor, said inner concave wall, said inner floor, and said upper rim are formed of a flexible and translucent material.

17. The vessel of claim 13 wherein;

said first chemiluminescent fluid is an activator for said chemiluminescent reaction.

18. The vessel of claim 13 wherein;

said second chemiluminescent fluid is an oxalate for said chemiluminescent reaction.

19. The vessel of claim 13 wherein;

said lower floor is defined by a lower rim, and said lower rim depends from said lower floor.

20. The vessel of claim 19 wherein;

said lower rim extends below said capsule.

* * * * *